US005769693A

United States Patent [19]

Wadephul

[11] Patent Number: 5,769,693

[45] Date of Patent: Jun. 23, 1998

[54] IMPELLER WHEEL

[76] Inventor: Jost Wadephul, Ketzendorfer Grund 23, D-21614 Buxtehude, Germany

[21] Appl. No.: 849,656

[22] PCT Filed: Sep. 25, 1996

[86] PCT No.: PCT/EP96/04178

§ 371 Date: May 30, 1997

§ 102(e) Date: May 30, 1997

[87] PCT Pub. No.: WO97/12726

PCT Pub. Date: Apr. 10, 1997

[30] Foreign Application Priority Data

Sep. 30, 1995 [DE] Germany ..... 195 36 723.5

[51] Int. Cl.[6] ..... B24C 5/06; B24C 7/00

[52] U.S. Cl. ..... 451/95; 451/96; 451/97; 451/446

[58] Field of Search ..... 451/95, 91, 96, 451/97, 98, 446

[56] References Cited

U.S. PATENT DOCUMENTS

| | | | |
|---|---|---|---|
| 2,261,185 | 11/1941 | Rosenberger . | |
| 2,363,437 | 11/1944 | Peterson | 451/95 |
| 2,385,728 | 9/1945 | Potter . | |
| 2,507,166 | 5/1950 | Lehman . | |
| 3,872,624 | 3/1975 | Ramaswamy . | |
| 4,759,156 | 7/1988 | Baumgart . | |
| 4,941,297 | 7/1990 | Carpenter | 451/98 |

FOREIGN PATENT DOCUMENTS

| | | |
|---|---|---|
| 0026996 | 4/1981 | European Pat. Off. . |
| 3913876 | 10/1990 | Germany . |
| 58-181573 | 10/1983 | Japan . |

*Primary Examiner*—Timothy V. Eley
*Assistant Examiner*—Derris H. Banks
*Attorney, Agent, or Firm*—Robert W. Becker & Associates

[57] ABSTRACT

An impeller wheel has at least one lateral disk and an impeller cage connected centrally on a first face of the lateral disk. Blasting material to be distributed with the impeller wheel is introduced in an axial feeding direction into a central area of the impeller cage. Radial blades are connected to the first face of the lateral disk. Guide blades are connected to the first face of the lateral disk and positioned between the radial blades. The radial blades have radially inner ends spaced at a first distance from a center of the lateral disk and the guide blades have radially inner ends spaced at a second distance from the center of the lateral disk. The second distance is greater than the first distance. The impeller cage is embodied as an auxiliary impeller wheel having auxiliary blades. The auxiliary blades have a greater axial length than the radial blades.

6 Claims, 2 Drawing Sheets

IMPELLER WHEEL

BACKGROUND OF THE INVENTION

The invention relates to an impeller wheel with radially extending blades which are connected to at least one lateral disc and whose inner ends are spaced at a distance to the center, further including an impeller cage with unloading openings arranged in the central area of the lateral disc which rotates together with the impeller wheel and in whose central area the blasting medium to be accelerated is introduced in the axial direction.

SUMMARY OF THE INVENTION

With devices furnished with such impeller wheels, which devices are, for example, known from German Offenlegungsschrift 25 38 228, surfaces of metallic rolled products are freed of scales and/or rust before a protective coating is applied to the surface, whereby against the surface a blasting medium is blasted which is comprised of fine metal particles. In such an impeller wheel all particles of the blasting medium, upon exiting the impeller wheel, move outwardly radially and substantially parallel to the blades. A considerable number of these particles impinges on the lateral discs and the blades and rebounds therefrom like a pingpong ball. This is not only negative with regard to the exit velocity of the blasting medium from the impeller wheel, but also results in a non-uniform distribution of the blasting medium on the surface to be cleaned. The impact of the blasting medium particles onto the parts of the impeller wheel results in considerable wear.

The impeller wheel according to the present invention is primarily characterized by:

at least one lateral disk;

an impeller cage connected centrally on a first face of the lateral disk, wherein a blasting material to be distributed with the impeller wheel is introduced in an axial feeding direction into a central area of the impeller cage;

radial blades connected to the first face of the lateral disk;

guide blades connected to the first face of the lateral disk and positioned between the radial blades;

the radial blades having radially inner ends spaced at a first distance from a center of the lateral disk and the guide blades having radially inner ends spaced at a second distance from the center of the lateral disk;

the second distance being greater than the first distance;

the impeller cage embodied as an auxiliary impeller wheel comprising auxiliary blades;

the auxiliary blades having a greater axial length than the radial blades.

The auxiliary blades have free ends remote from the lateral disk and the free ends taper in a direction counter to the feeding direction of the blasting material.

The impeller wheel may further comprise a funnel-shaped sleeve arranged in the vicinity of the free ends and widening in the feeding direction.

The lateral disk has a second face opposite the first face, and the second face has ribs.

The impeller wheel is preferably embodied as a welded construction.

The auxiliary impeller is expediently driven independently of the impeller wheel.

It is an object of the invention to reduce the wear of the impeller wheel resulting from the blasting medium and to simultaneously generate a blasting pattern having uniform coverage over the entire exit angle of the blasting medium from the impeller wheel and having approximately parallel lateral borders.

This object is inventively solved based on an impeller wheel of the aforementioned kind such that between the blades of the impeller wheel guide blades are arranged the inner ends of which have a greater distance to the center of the impeller wheel than those of the blades and the impeller cage is embodied as an auxiliary impeller wheel. The axial length of the blades of the auxiliary impeller wheel is greater than that of the blades of the impeller wheel by a considerable amount.

Due to the inventive embodiment of the impeller cage as an auxiliary impeller wheel the introduced blasting medium, before entering the impeller wheel, already moves on a circular path so that the blasting medium which exits the auxiliary impeller wheel, enters on a spiral circumferential path the impeller wheel so that the impact of blasting medium onto the blades of the impeller wheel is substantially prevented. For improving the spiral movement of the blasting medium along its path through the impeller wheel, the guide blades participate in that they catch stray blasting medium and channel it so that a uniform distribution of the blasting medium onto the surface to be treated is achieved. In a preferred embodiment of the invention the blades of the auxiliary impeller wheel taper in the direction of the inlet end so that, upon rotation of the impeller wheel, they form, in the direction of flow of the blasting medium, a conically tapering hollow space via which the blasting medium, for increasing the throughput, can optimally enter the blade area of the auxiliary impeller wheel. In this context it has been especially advantageous to arrange at the free ends of the blades of the auxiliary impeller wheel a truncated cone-shaped sleeve that widens in the flow direction of the blasting medium. This sleeve can also be formed by a corresponding funnel-shaped widened portion of the outlet end of the inlet tube for the blasting medium to a blasting device.

In another expedient embodiment of the invention, ribs are provided at the outer surface or surfaces of the lateral disc or discs of the impeller wheel. With these ribs the blasting medium entering the space between the impeller wheel and the housing thereof is radially outwardly guided so that a seal between the housing and the drive shaft of the impeller wheel is obsolete.

Due to the reduced wear resulting from the inventive measures, the impeller wheel can be embodied as a welded construction with straight or curved blades, which results in a considerable weight reduction.

BRIEF DESCRIPTION OF THE DRAWINGS

One embodiment of the invention will be explained with the aid of the drawings. It is represented in.

DESCRIPTION OF PREFERRED EMBODIMENTS

Figure 1:
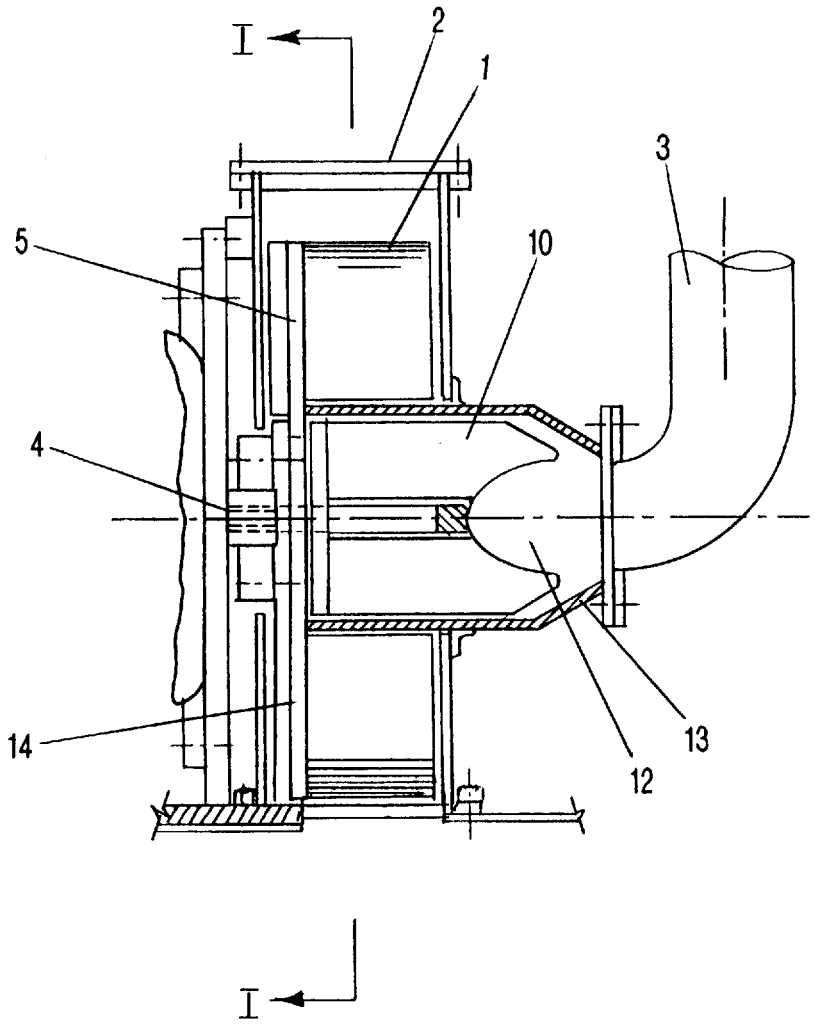
FIG. 1 a schematic sectional view of the inventive impeller wheel which is arranged in a housing.
Figure 2:
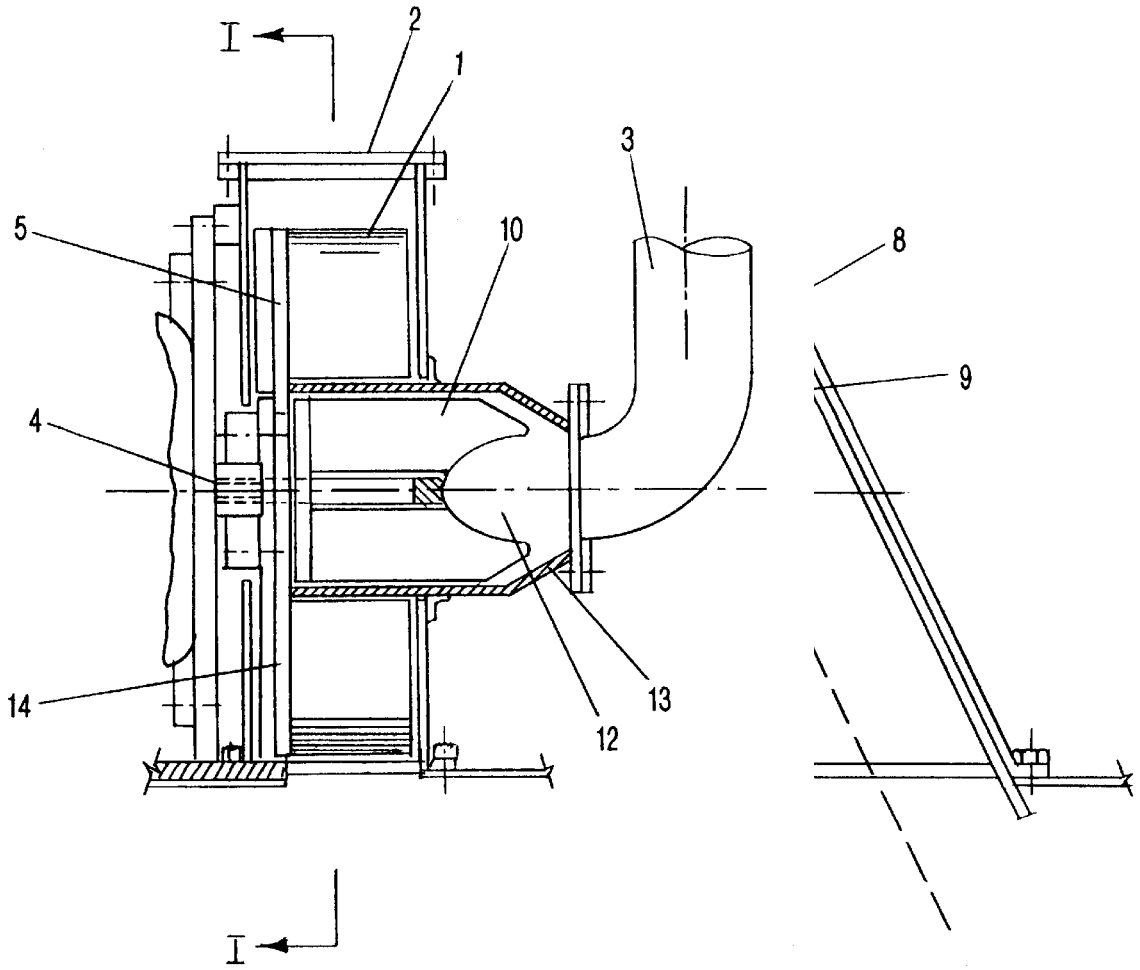
FIG. 2 a schematic sectional view of the impeller wheel and housing along the line I—I of FIG. 1.

The represented impeller wheel 1 is surrounded by housing 2 in whose central area an inlet tube 3 opens with which the blasting medium, such as quartz sand or small steel particles, is fed into the impeller wheel 1. Opposite the opening of the inlet tube 3 the drive shaft 4 of the impeller wheel 1 projects from the housing 2.

The impeller wheel 1 comprises a lateral disc 5 which is fastened to the drive shaft 4 and, at the surface opposite the drive shaft 4, has radial blades 6 the inner ends of which border a distribution sleeve 7 with a distribution opening 8. Between the blades 6 guide blades 9 are secured at the lateral disc 5 the inner ends of which, in contrast to the inner ends of the blades 6 are spaced at a distance to the distribution sleeve 7. Within the distribution sleeve 7 an auxiliary impeller wheel 10 is embodied which is rotationally fixedly connected to the drive shaft 4, respectively, the lateral disc 5. The axial length of the auxiliary blades 11 of the auxiliary impeller wheel 10 is greater than that of the blades 6 and the guide blades 9 of the impeller wheel 1 by a considerable amount. The free ends of the blades 11 of the auxiliary impeller wheel 10 taper in the direction to the inlet end for the blasting medium, respectively, the inlet tube 3 in an arrow-shaped fashion so that in the interior of the rotating auxiliary impeller wheel 10 a conical or cup-shaped hollow space 12 is produced extending in the direction toward the lateral disc 5 via which the blasting medium enters the auxiliary impeller wheel 10. The tapering free ends of the blades 11 of the auxiliary impeller wheel 10 project into the funnel-shaped widening end 13 of the inlet tube 3 that matches the blade shape.

On the face of the lateral disc 5 opposite the blades 6 ribs 14 are provided.

The invention is not limited to the represented and disclosed embodiment. It includes variations obvious to a person skilled in the art. For example, at the impeller wheel between the individual blades 6 more than a respective single guide blade 9 may be provided. The guide blades 9 may have the same radial length as the blades 6 and therefore project past the outer ends of the blades 6.

The present invention is, of course, in no way restricted to the specific disclosure of the specification and drawings, but also encompasses any modifications within the scope of the appended claims.

What I claim is:

1. An impeller wheel comprising:

at least one lateral disk;

an impeller cage connected centrally on a first face of said lateral disk, wherein a blasting material to be distributed with said impeller wheel is introduced in an axial feeding direction into a central area of said impeller cage;

radial blades connected to said first face of said lateral disk;

guide blades connected to said first face of said lateral disk and positioned between said radial blades;

said radial blades having radially inner ends spaced at a first distance from a center of said lateral disk and said guide blades having radially inner ends spaced at a second distance from said center of said lateral disk;

said second distance being greater than said first distance;

said impeller cage embodied as an auxiliary impeller wheel comprising auxiliary blades;

said auxiliary blades having a greater axial length than said radial blades.

2. An impeller wheel according to claim 1, wherein said auxiliary blades have free ends remote from said lateral disk and wherein said free ends taper in a direction counter to said feeding direction of the blasting material.

3. An impeller wheel according to claim 2, further comprising a funnel-shaped sleeve arranged in the vicinity of said free ends and widening in said feeding direction.

4. An impeller wheel according to claim 1, wherein said lateral disk has a second face opposite said first face and wherein said second face has ribs.

5. An impeller wheel according to claim 1, embodied as a welded construction.

6. An impeller according to claim 1, wherein said auxiliary impeller is driven independently of said impeller wheel.

* * * * *